US005791967A

United States Patent [19]

Yeh

[11] Patent Number: 5,791,967

[45] Date of Patent: Aug. 11, 1998

[54] TOY CAR

[76] Inventor: Ping-Lin Yeh, P.O. Box 90, Tainan 704, Taiwan

[21] Appl. No.: 807,277

[22] Filed: Feb. 28, 1997

[51] Int. Cl.[6] ..... A63H 17/273; A63H 17/32; A63H 17/25

[52] U.S. Cl. ..... 446/279; 446/288; 446/409; 446/470

[58] Field of Search ..... 446/268, 270, 446/279, 288, 465, 462, 470, 457, 409

[56] References Cited

U.S. PATENT DOCUMENTS 4,925,427 5/1990 Wu ..... 446/409
5,069,649 12/1991 Wu ..... 446/288
5,360,367 11/1994 Ho ..... 446/470

*Primary Examiner*—Robert A. Hafer
*Assistant Examiner*—Laura Fossum

[57] ABSTRACT

A toy car has a doll with a pistol in hand sitting on a seat respectively near to two opposite doors and a a small police car and a small motorcycle respectively at two sides in a car body. The two dolls and the small police car and the small motorcycle are intermittently moved out of and in the car body respectively by an upper push arm unit and a lower push arm unit pushed respectively by an upper cam and a lower cam both rotated by a gear system rotated by a motor powered by electricity.

3 Claims, 9 Drawing Sheets

TOY CAR

BACKGROUND OF THE INVENTION

This invention concerns a toy car, particularly having dolls with pistols inside to appear out of doors and a small police par and a motorcycle to extend out of the body.

Toy cars have widely been popular among children, and quite a variety of them are in market, offered by makers always trying to design new kinds of toy cars.

SUMMARY OF THE INVENTION

This invention has been made to offer a new kind of toy car having alterations interesting enough for attracting children's curiosity.

A main feature of the invention is two dolls respectively with a pistol in a hand sitting inside the car to intermittently appear out of two opposite doors and moving back inside by means of an upper push arm unit having two push arms to push the doors open and two seats on which the dolls sit.

Another main feature of the invention is a small police car and a small motorcycle deposited inside the body to appear intermittently out of two sides of the body by means of a lower push arm unit having two push arms to push them out.

BRIEF DESCRIPTION OF DRAWINGS

This invention will be better understood by referring to the accompanying drawings, wherein.

DESCRIPTION OF THE PREFERRED EMBODIMENT

Figure 1:
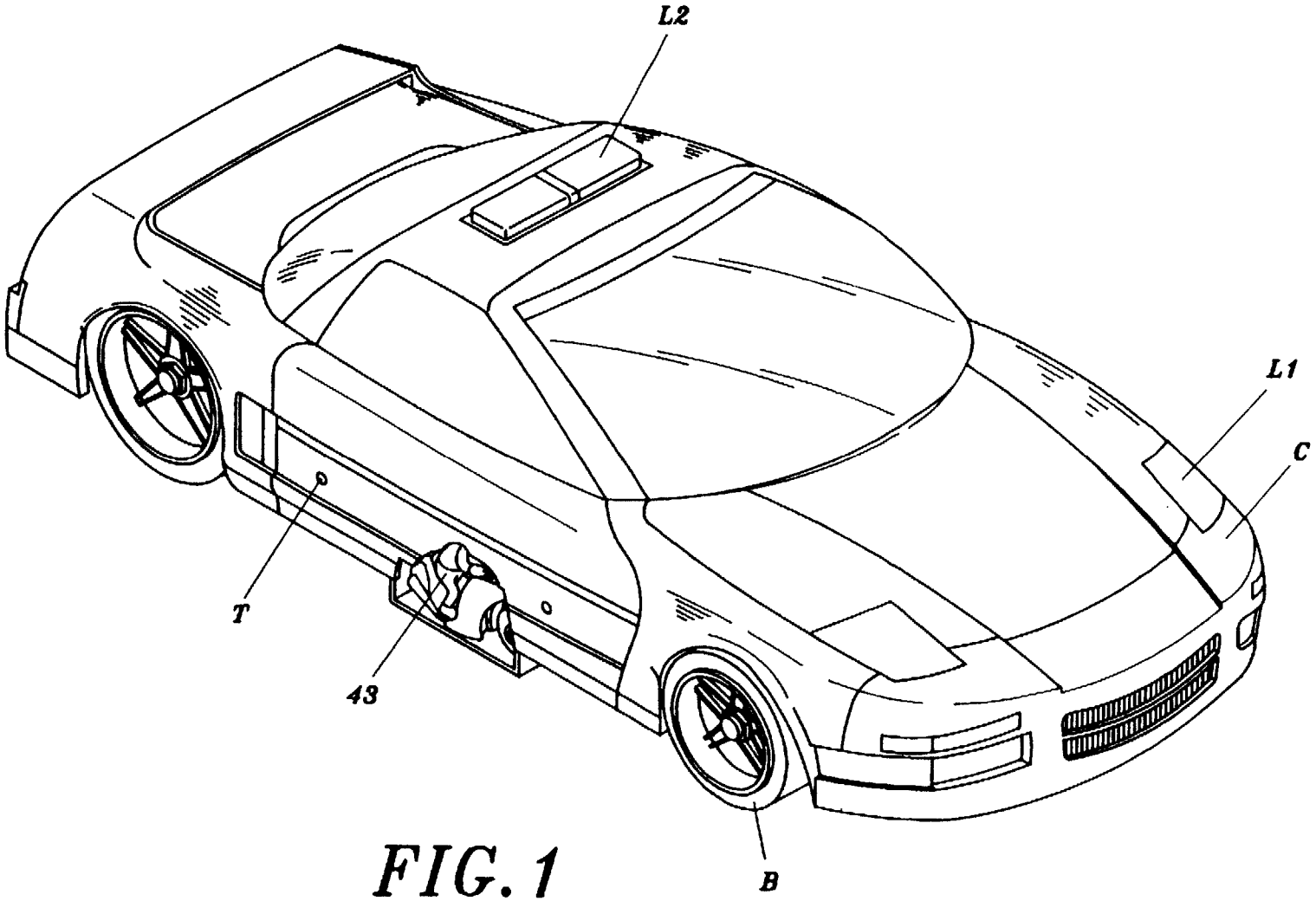
FIG. 1 is a perspective view of a preferred embodiment of a toy car in the present invention.

A preferred embodiment of a toy car in the present invention, as shown in FIGS. 1–6, includes a body B, and a roof C screwed with the body B.

The body B includes a transmission set 1, an upper push arm unit 3, a lengthwise push rod 3, a lower push arm unit 4, an upper cam 5 and a lower cam 6 as main components combined together.

The transmission set 1 includes an upper base 10, a lower base 11, a motor 12 fixed between the upper base 10 and the lower base 11, and a gear system 13 consisting of an upper gear unit 131 and a lower gear unit 132. The motor 12 has a shaft 120 connected with a gear of the gear system 13 shown in FIG. 5, which has plurality shafts 130 respectively connected with the upper gear unit 131 and the lower gear unit 132 and then combined with the upper base 10 and the lower base 11. The upper gear unit 131 and the lower gear unit 132 are rotated synchronously by a pair of worms 133. But the gear system 13 is a well known arts, not included in the claims and not to be described minutely here.

Further, a shaft 130 is provided to extend from the front of the lower gear unit 132, having its top connected with a disc 14, which has a projection 140 on an upper side, and a Z-shaped control rod 15 is located across above the disc 14, having a long slot 150 for the projection 140 to fit therein and to be moved to and fro by the projection 140 when the disc 14 is rotated by the gear system 13. The front end of the control rod 15 is connected with a headlight L1, closing and opening the headlight Li. Further, a cam 16 is provided below the disc 14, and a rear control plate spring set N1 is provided at one side of the cam 16, connected with electric wires of power so as to control lights of the toy car. A rear control plate spring group N2 is provided at a rear side of the upper base 10, connected with an IC and a buzzer V for giving out warning sounds, machinegun sounds, police car sounds, motorcycle sounds etc. But this light control structure is a well known art, not included in the claims.

The upper push arm unit 2 is combined with an upper base 10 of the transmission set 1, having two lateral push arms 20, 20' respectively provided with a rack 200, 200' on a vertical side to face each other. A part of the rack 200, 200' engages with two sides of an upper transmitting gear 21 so that the two upper push arms 20, 20' may be moved to the opposite direction synchronously. Further two L-shaped seats 22, 22' are respectively provided to be located at an outer end of each lateral push arms 20, 20' for depositing a doll policeman with a pistol in a hand thereon. The seats 22, 22' are located near doors C1, C1 able to be swung open outward by means of coil springs S1, S1, which have one end fixed with the body B and the other end fixed with the lower portion of the door C1. Then after the seats 22, 22' are pulled inward, the door C1 is pulled to close by elasticity of the spring S1. A horizontal shield 23 is provided above the lateral push arms 20, 20' and the upper transmitting gear 21, screwed with the upper base 10 in place. Further, a coil spring S2 is provided to have one end fixed on the push arm 20 and the other end fixed with the shield 23 to pull back the push arms 20, 20' after pushed outward by the upper cam 5.

The lengthwise push rod 3 is provided to be located in a right angle position to the push arms 20, 20' of the upper push arm unit 2, having a U-shaped frame 30 at one end for fixing a reversible flash light L2. The lengthwise push rod 3 further has a projection on a rear side to connect with a spring S3 fixed on the upper base 10, permitting the lengthwise push rod 3 to slide forward and backward. Further, the push rod 3 has a control wall 32 facing the rear control plate spring N2 to cooperate with an IC for giving out several sounds and lighting signal lights when the push rod 3 is slided forward and backward.

Figure 6:
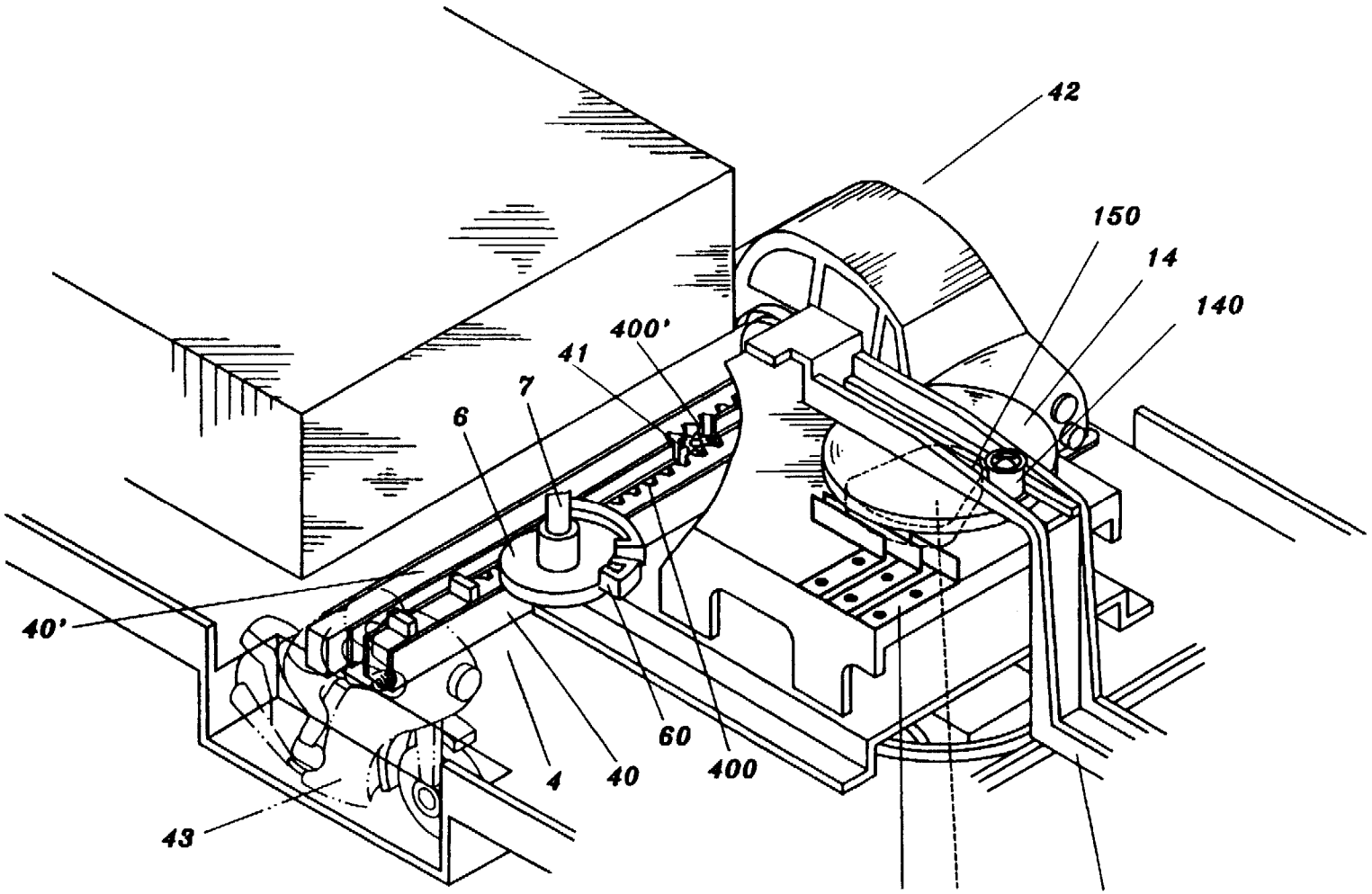
FIG. 6 is a perspective view of a lower push arm unit of the toy car in the present invention.
Figure 7:
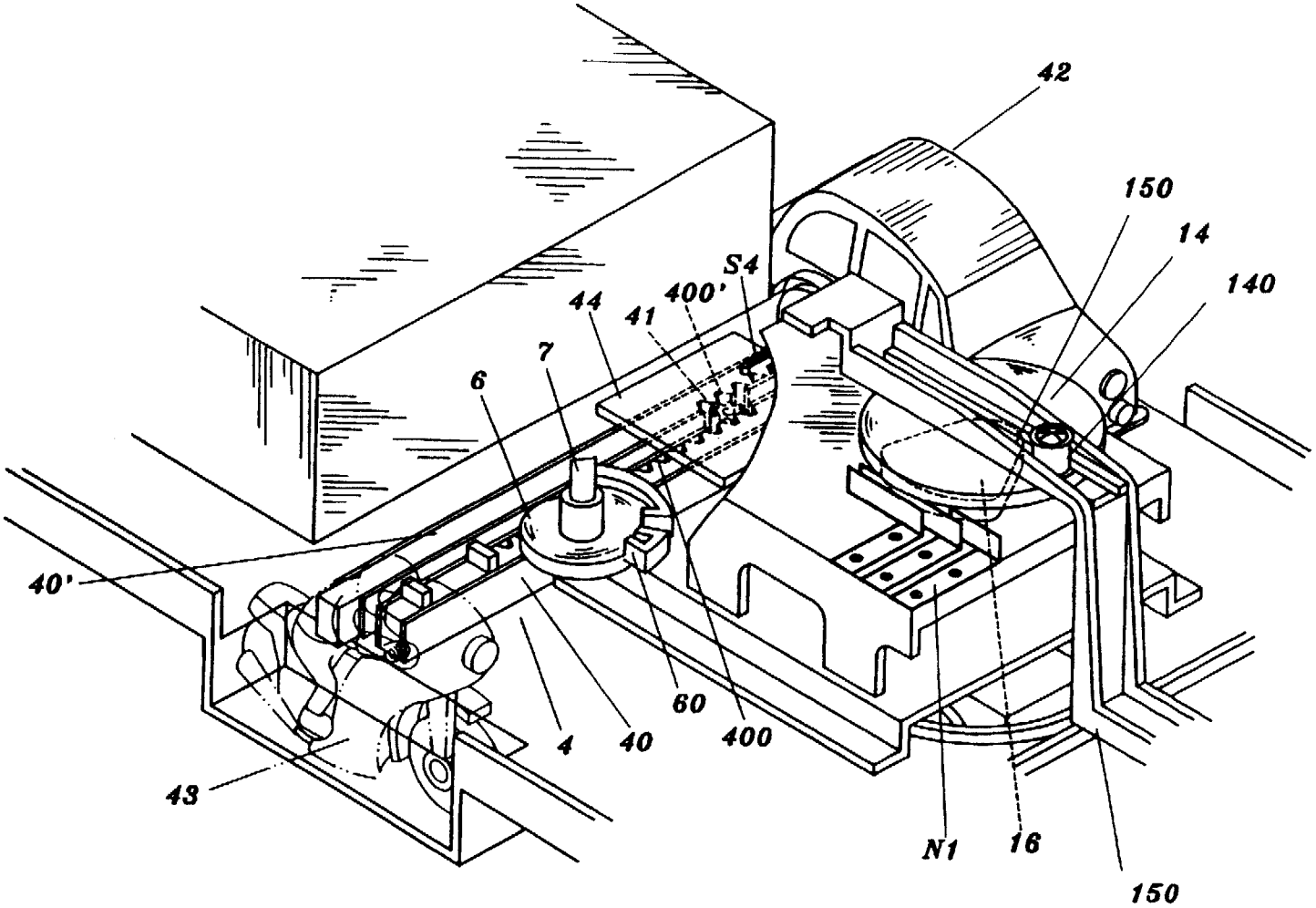
FIG. 7 is another perspective view of the lower push arm unit thee toy car in the present invention.

The lower push arm unit 4, as shown in FIGS. 6 and 7, is fixed on a rear portion of the lower base 11, having two lateral push arms 40, 40', a rack 400, 400' respectively formed on a vertical side of the push arms 40, 40' to face each other, a lower transmitting gear 41 between the two racks 400, 400' and engaging with the two racks 400, 400'. The outer ends of the push arms 40, 40' are respectively connected with a small police car 42 and a small motorcycle 43. Further, a horizontal shield 44 is provided above the push arms 40, 40' and the lower transmitting gear 41. The push arm 40 is fixed with a spring S4 having one end firmly connected with the shield 44 so that the push arms 40, 40' may be pulled back after pushed outward by the lower cam 6.

The upper cam 5 and the lower cam 6 are respectively provided to be located on the upper base 10 and the lower base 11, fixed on a vertical shaft 7 and respectively facing the upper push arm unit 2 and the lower push arm unit 4. The upper cam 5 has a curved upright wall 50 projecting upright from an outer edge and a recessed outer edge 51, and the lower cam 6 has a curved upright wall 60 projecting upright from an outer edge. The curved upright wall 50 and the recessed outer edge 51 of the upper can 5 do not align to the curved upright wall 60 of the lower can 6. Then the upper and lower cam 5 and 6 are respectively located to have the outer edge near one end of the upper push arms 20, 20' and the lower push arms 40, 40'. The curved upright wall 50 and the recessed outer edge 51 of the upper cam 5 cam push the upper push arms 20, 20' of the upper push arm unit 2 in opposite direction to push open the doors C1, C1 and the seats 22, 22' and the dolls with the pistol pushed out at the same time. Meanwhile, the push arms of the lower push arm unit 4 is pushed outward by means of the curved upright wall 60 of the lower cam 6 so that the small police car 42 and the small motorcycle 43 may be pushed out of the body B.

Figure 2:
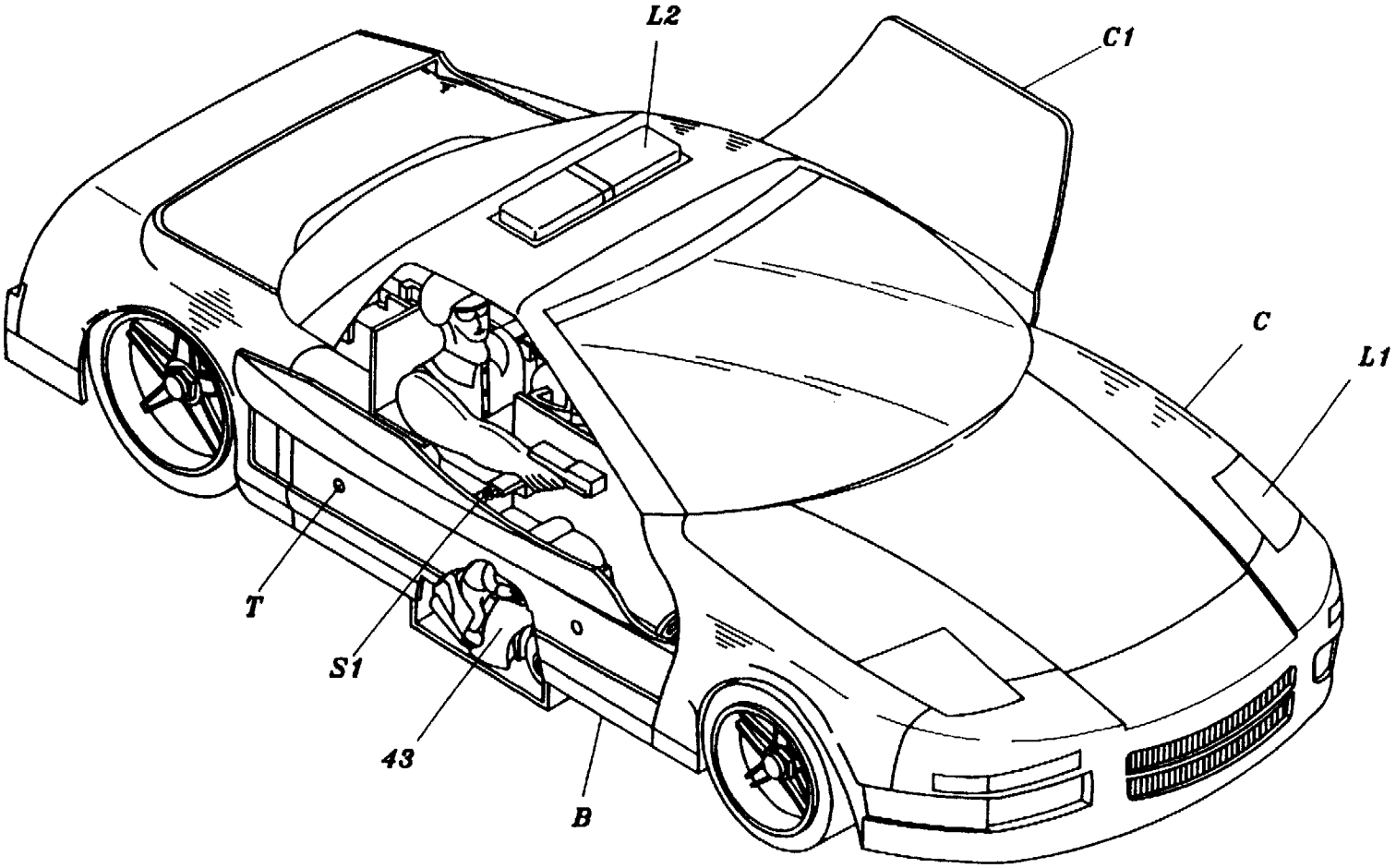
FIG. 2 is another perspective view of the preferred embodiment of a toy car in the present invention.
Figure 3:
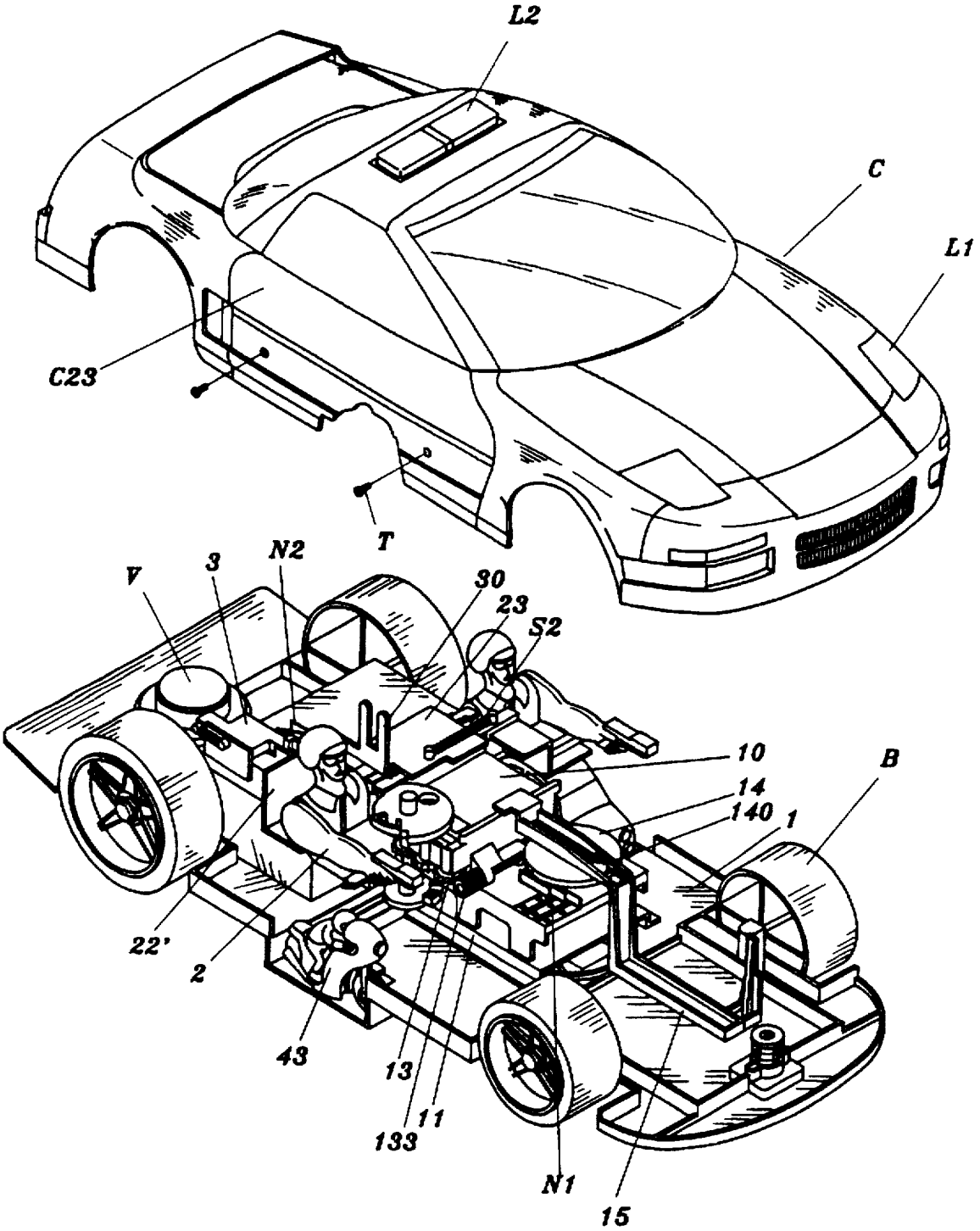
FIG. 3 is an exploded perspective view of the preferred embodiment of a toy car in the present invention.
Figure 4:
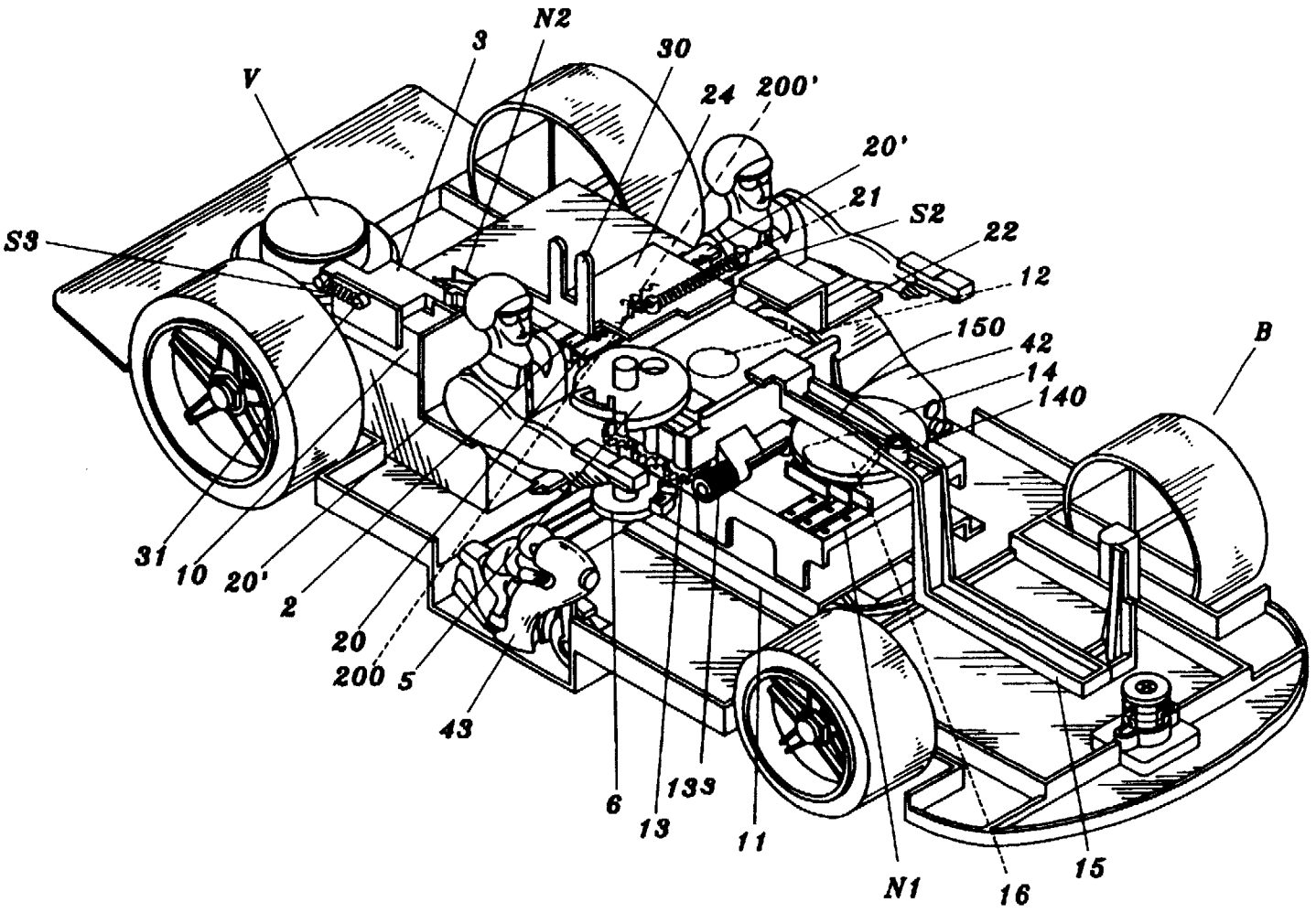
FIG. 4 is a perspective view of a body of the preferred embodiment of a toy car in the present invention.
Figure 5:
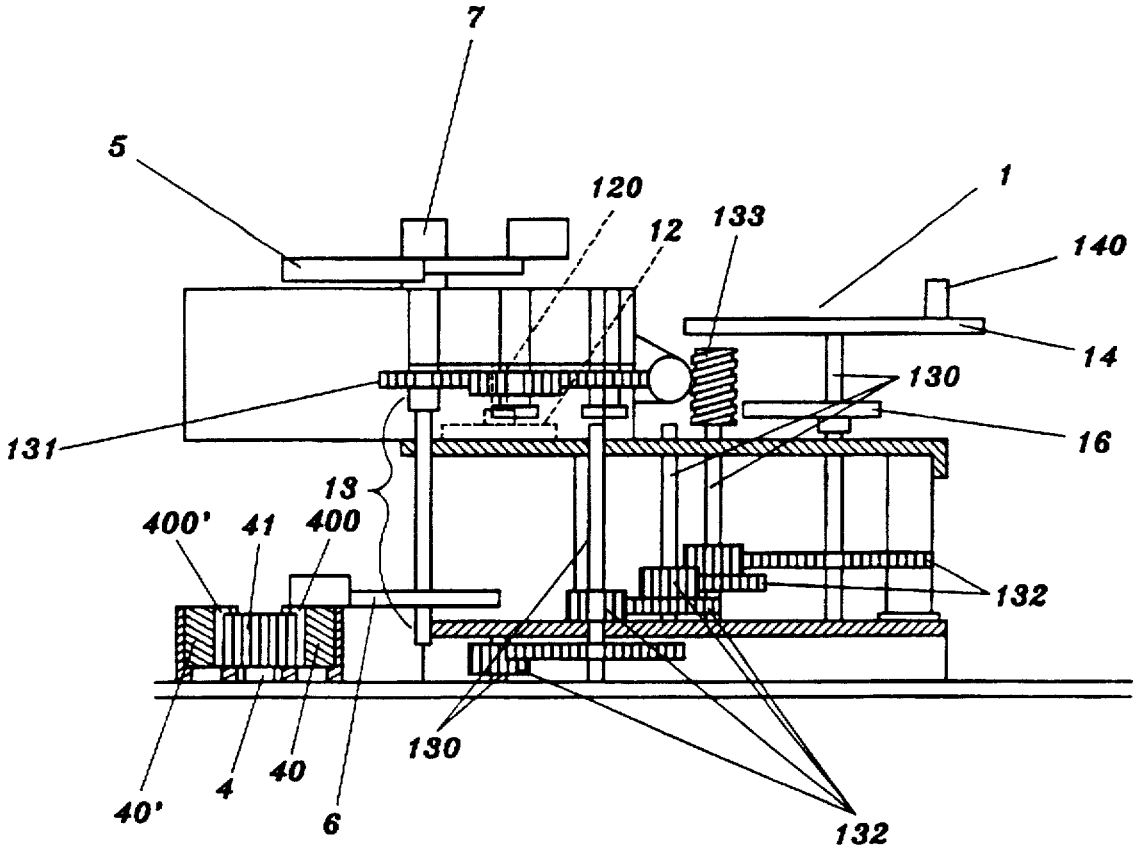
FIG. 5 is a cross-sectional view of a gear system of the toy par in the present invention.

The flash light L2, as shown in FIGS. 1–3, is pivotally fixed on the roof C and having a flat plate fixed on the U-shaped frame 30 of the lengthwise push rod 3 so that the flash light L2 may be swung and rotated by the U-shaped frame 30.

After the toy car is assembled together according to FIGS. 1, 2, 7 and 8, the roof C is screwed with the body B, finishing assemblage of the toy car.

Figure 8:
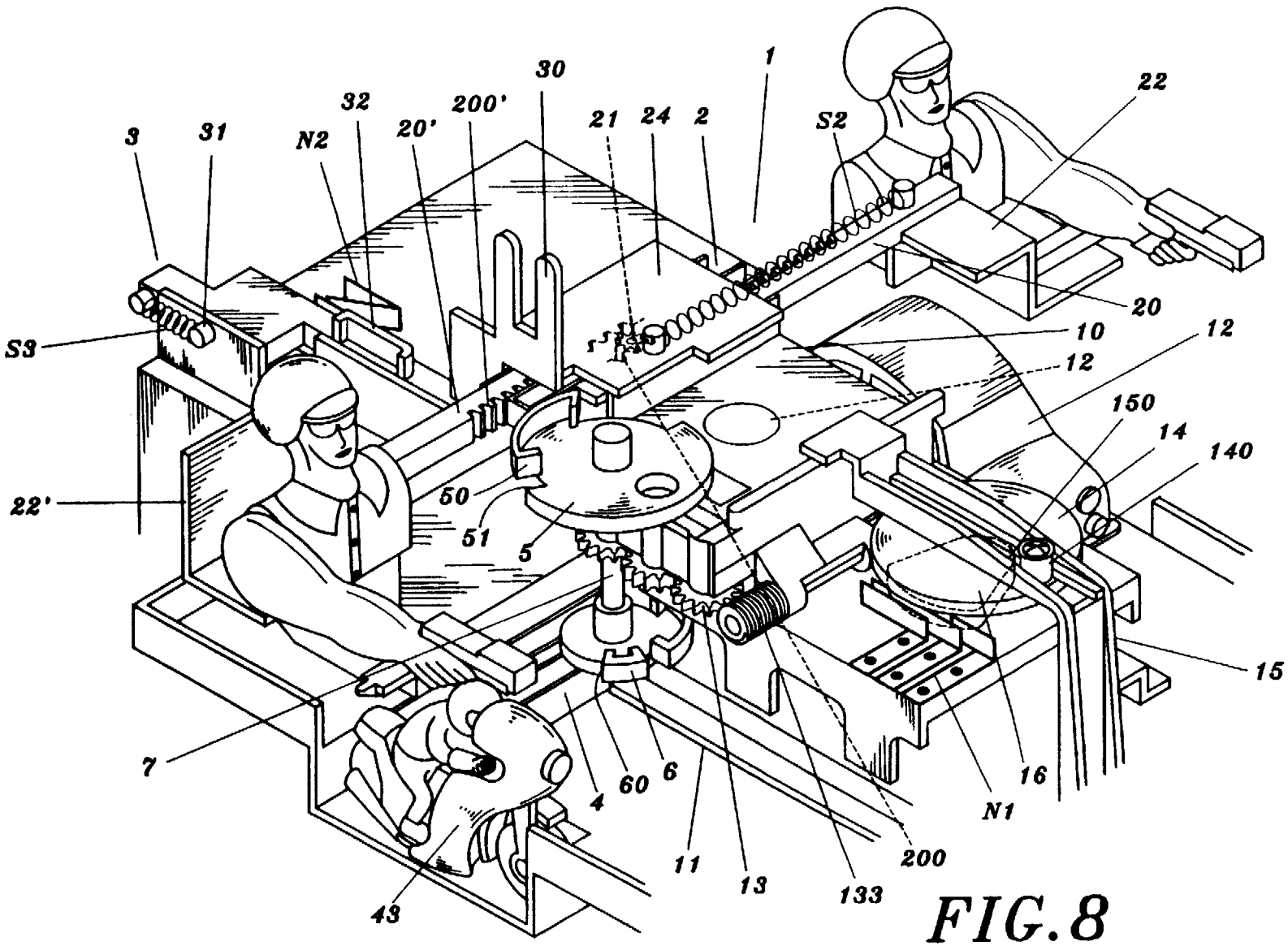
FIG. 8 is a perspective view of an upper cam pushing upper push arms of the toy car in the present invention; and, FIG. 9 is a perspective view of a lower cam pushing lower push arms of the toy car in the present invention.

In using, the power is started, electrifying the motor 12 to rotate the shaft 120, which in turn rotates the gear system 13 to move the control rod 15 forward and backward. Then the headlight C1 is lit up, and the cam 16 is rotated to contact with the plate springs N1 intermittently to make the light flash. And the upper cam 5 and the lower cam 6 are rotated by the gear system 13 at the same time, with the curved upright wall 50 push the lengthwise push rod 3 forth and back and contact with the control plate springs N2 to operate the IC to sound out the buzzer V, and with the U-shaped frame 30 of the lengthwise push rod 3 push and swing the flash light L2, and with the recessed outer edge 51 of the upper cam 5 turn to the push arm 20 of the upper push arm unit 2 as shown in FIG. 8 and continue to move the upper push arm 20 outward to push open the door C1 as shown in FIG. 2. Then, the upper push arm 20 also moves the rack 200' of the push arm 20' via the upper transmitting gear 21 to opposite direction so that the frame 22, 22' with the dolls with the pistols may push open the doors C1, C1 to move out of them, wherein the springs S1, S1 and S2, S2 are all in extended condition.

Figure 9:
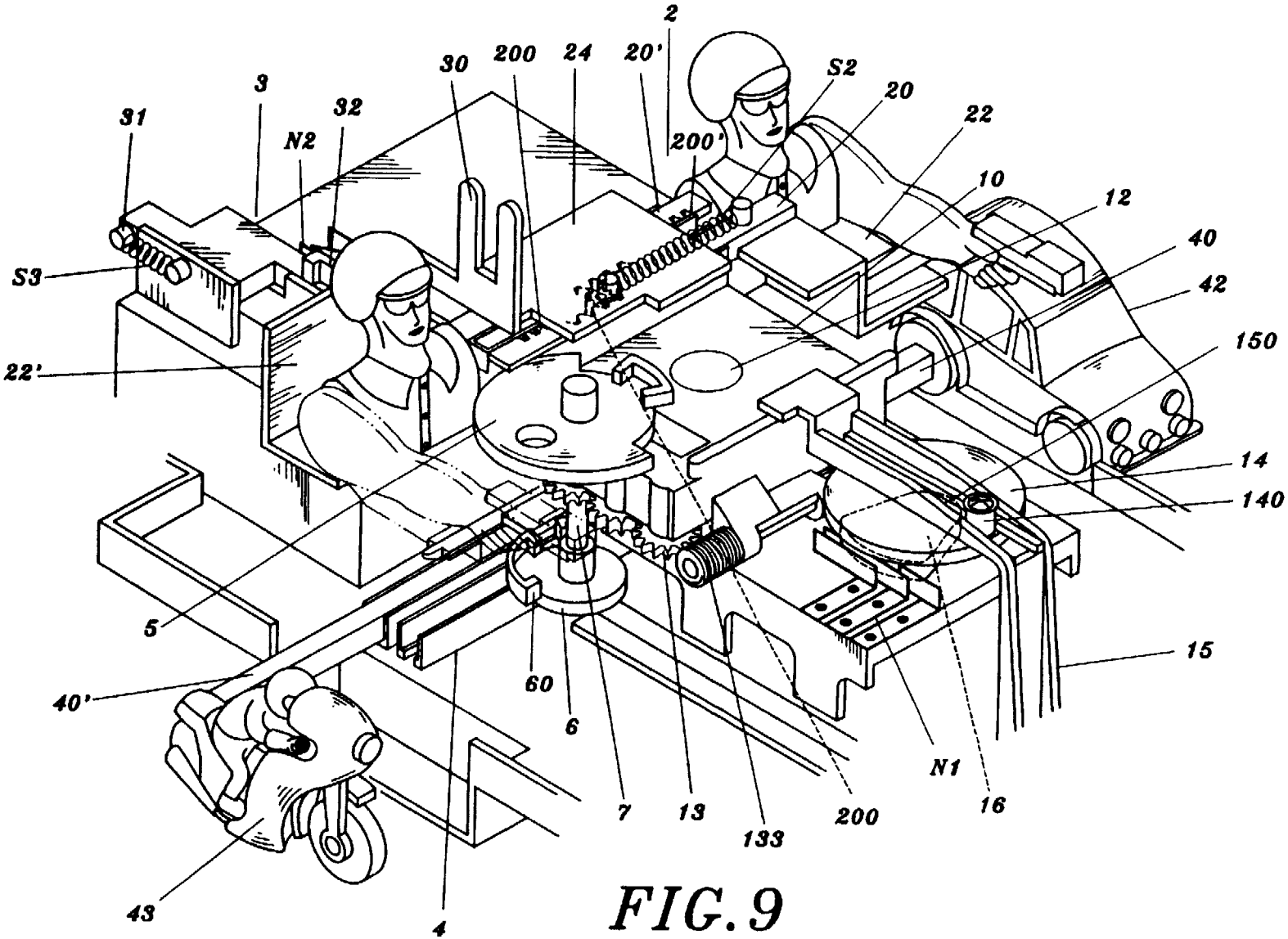

After the recessed outer edge 51 of the upper cam 5 continues to rotate and separates from the push arm 20, the springs S1, S1, S2, S2 recover elasticity to pull back the push arms 20, 20' to an original position. Meanwhile, the lower cam 6 is rotated by the gear system 13, with the curved upright wall 60 turn to face the lower push arm unit 4 as shown in FIGS. 8 and 9, and continuing to move the lower push arm 40 outward to move the push arm 40' via the transmitting gear 41 out of the body B so that the small police car 42 and the small motorcycle 42 extend out of the body B, too, When the seats 22, 22' with the dolls with the pistols recover their original position after they are moved out of the body B, the lower cam 6 has the curved upright wall 60 rotating to contact and push the lower push arm unit 4, with the push arms 40, 40' pushing the small police car 42 and the small motorcycle 43 out of the body B as shown in FIG. 9. Once the lower cam 6 rotates further to let the curved upright wall 60 separate from the lower push arm unit 4, with the force pushing the push arms 40, 40' disappearing, the springs S4 recover elasticity to pull back the lower push arm unit 4 together with the police car 42 and the motorcycle 43 in the body B as shown in FIG. 1.

While the preferred embodiment of the invention has been described above, it will be recognized and understood that various modifications may be made therein and the appended claims are intended to cover all such modifications which may fall within the spirit and scope of the invention.

What is claimed is:

1. A toy car comprising:

a body, with a roof attached thereto, said body comprising:

a transmission set having an upper base, a lower base, a motor fixed between said upper base and said lower base and having a shaft connected with a transmitting gear of a gear system, said gear system including an upper gear unit and a lower gear unit connected with a pair of worms to rotate synchronously, a disc fixed on an upper end of a shaft in front of said lower gear unit, said disc combined with a Z-shaped control rod;

an upper push arm unit combined with said upper base, having two lateral push arms each provided with a rack on a vertical side facing each other respectively, said rack of each said lateral push arm engaging with said transmitting gear fixed between said two racks, two seats, each seat being respectively combined with an outer end of each said push arm, a doll with a pistol in a hand being deposited on each of said seats, said seat respectively located close to two opposite doors, each of said doors connected with a spring to be tightly pulled to a closed position a shield provided on said upper push arm unit and firmly fixed with said upper base, a second spring fixed between one of said push arms of said upper arm unit and said shield for pulling back said push arms when said push arms are moved out of said body;

a lower push arm unit located behind said lower base of said transmission set device, having a second set of lateral push arms, each said second set of lateral push arms having a rack on a vertical side facing each other, a lower transmitting gear provided between and engaging with said two racks of said second set of lateral push arms, a small police car and a small motorcycle respectively fixed with an outer end of each said lateral arms, a shield provided on said lower push arm unit, a third spring fixed between one of said push arms and said shield so as to pull back said push arms when said second set of lateral push arms are pushed out of said body;

an upper cam located to be rotated by said upper gear unit to push said upper arm unit and a lengthwise push rod, said upper cam having a curved upright wall and a recessed outer edge not aligned with said curved upright wall;

a lower cam located below and connected with said upper cam by means of a vertical shaft to rotate together synchronously, having a curved upright wall to face said lower arm unit and not aligning with said curved upright wall of said upper cam;

said lengthwise push rod located on one side of said two push arms of said upper push arm unit and positioned at a right angle to said two push arms, having a U-shaped frame at one end for reversing a flash light, a projection on a rear side for fixing a spring so as to let said length-wise push rod move forward and backward; and, said motor rotating said transmitting gear system, said upper cam rotated by said upper gear unit to push said upper arm unit which then push open said doors and said seats with said dolls with a pistol in a hand extending out of said body, said lower cam rotated by said lower gear unit to push said lower push arm unit which then pushes said small police car and said small motorcycle out of said body, said lower push arms pulled back by said springs when said lower cam further rotates to leave said lower push arm unit, said small police car and said small motorcycle being moved back into said body together with said lower push arm unit.

2. The toy car claimed in claim 1, wherein said disc of said transmission set further has a projection, on an upper surface and said Z-shaped control rod is located on said disc, having an elongate slot for said projection to fit and move therein so that said control rod is moved left and right, said control rod having its front end connected with a headlight so as to cover and swing open said headlight, a cam being provided under said disc, a set of front control plate springs provided beside said cam and connected with power wires for controlling lights of said toy car, a set of rear control plate springs provided behind said upper push arm unit and connected with an IC plate and a buzzer for giving out warning sounds, machine gun sounds and whistle sounds.

3. The toy car claimed as in claim 1, wherein said roof has a flash light on an upper surface, and said flashlight is connected with a U-shaped frame of said lengthwise push rod, having a flat movable plate pivotally connected with a bottom of said roof, able to be swung upward by said U-shaped frame when said upper and said lower cam rotates to push said push arms of said upper and said lower push arm unit to open said doors to push said lengthwise push rod.

* * * * *